United States Patent [19]

Cook, deceased et al.

[11] 4,029,134

[45] June 14, 1977

[54] DEVICE FOR REMOVING CIRCUMFERENTIALLY BARK FROM PLANTS

[76] Inventors: Ralph M. Cook, deceased, late of Hialeah; Ruth Nelson, Personal Representative of the Estate Cook, 6060 W. 10th Ave., Hialeah, Fla. 33012; Don T. Roach, 951 E. 33rd St., Hialeah, Fla. 33013

[22] Filed: Feb. 3, 1976

[21] Appl. No.: 654,778

[52] U.S. Cl. ..... 144/208 C; 30/299; 47/1 R; 144/311

[51] Int. Cl.[2] ..... B27L 1/00

[58] Field of Search ..... 144/311, 208 R, 208 C; 30/121, 299, 303, 280, 123.5; 47/1

[56] References Cited

UNITED STATES PATENTS

| | | | |
|---|---|---|---|
| 935,517 | 9/1909 | Johnson | 30/299 X |
| 2,841,924 | 7/1958 | Fink | 144/208 C X |
| 2,979,862 | 4/1961 | Tacdesan | 144/208 C X |

FOREIGN PATENTS OR APPLICATIONS

| | | | |
|---|---|---|---|
| 26,446 | 11/1912 | United Kingdom | 30/121 |

*Primary Examiner*—Othell M. Simpson

*Assistant Examiner*—W. D. Bray

*Attorney, Agent, or Firm*—Paul D. Boone

[57] ABSTRACT

The applicant's device for hand operation is characterized by two jaws, one the upper and the other the lower, which form an angle at their inner ends of a degree that permits the introduction of stems or branches of plants at their other end, the upper jaw having a roof from which two parallel blades descend, each of which blades has a cutting edge, the lower jaw having a base from which also two parallel blades project upward, each of which blades likewise has a cutting edge ; the upper jaw also has at its outer extremity a blade that extends downwardly at a slight inward slant and provided with a cutting edge, and the lower jaw also has at its outer extremity a blade with a cutting edge that extends upwardly at a slight inward slant; the inner end of the jaws is attached to a handle in fixed relationship, thus holding the jaws firm; the said device is rotatable with one hand circumferentially around the limb of the plant, thus making two parallel cuts in the bark, after which one of the blades at the outer extremity upon rotation of the device severs the bark from the plant with no or little damage to the plant, whereby air layering of it can be conducted at the wound.

4 Claims, 6 Drawing Figures

FIG. 1.
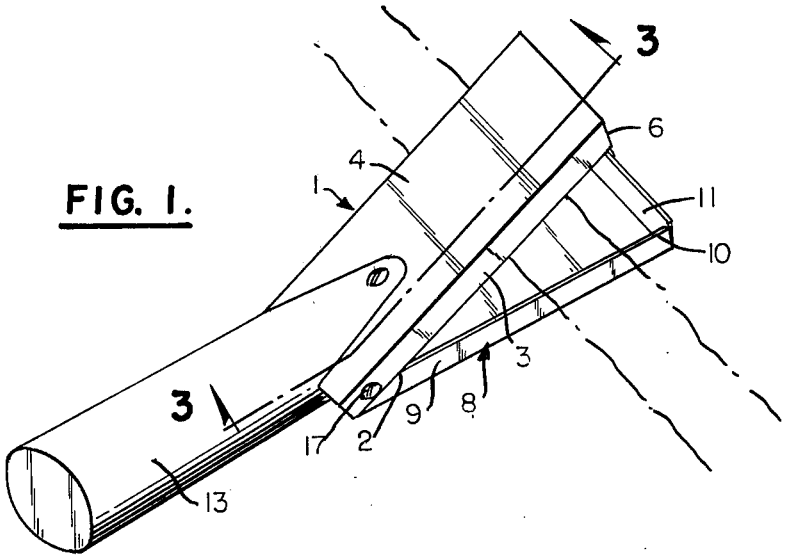
FIG. 2.
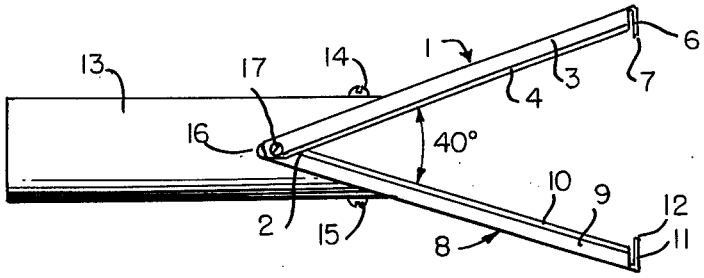
FIG. 3.
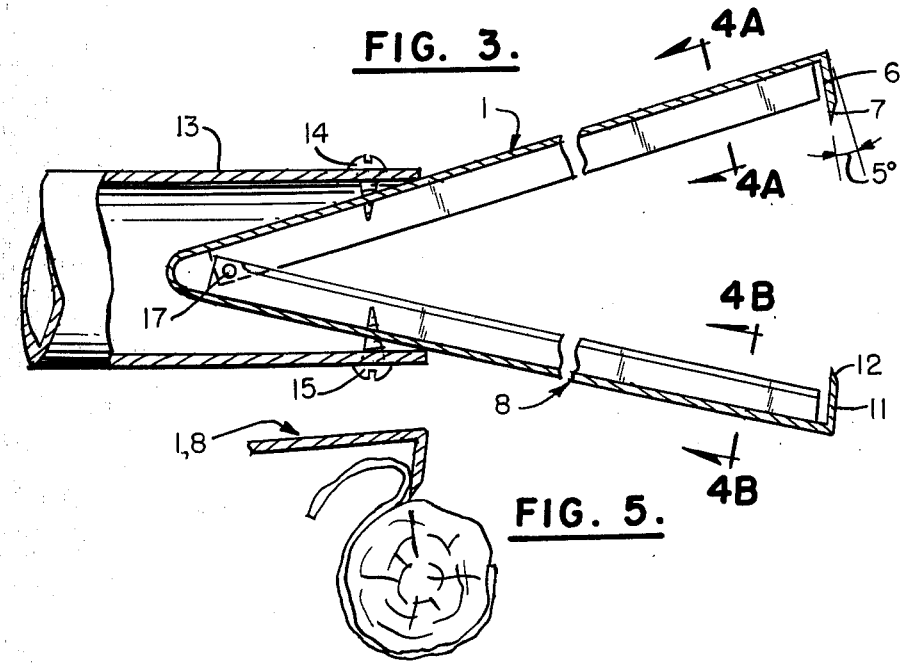
FIG. 4A.
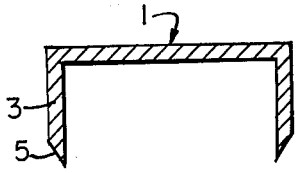
FIG. 4B.
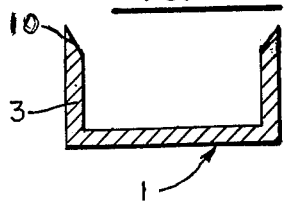
FIG. 5.

DEVICE FOR REMOVING CIRCUMFERENTIALLY BARK FROM PLANTS

I. THE SPECIFICATION OF THE INVENTION

1. The Objects of the invention, with reference to some prior art

This invention relates to a hand tool for circumferentially removing a section or band or bark from plants, which device or tool is safe for the operator as compared with sharp knives. The term "plant" herein denotes branches or the trunk of plants, shrubs, even small trees.

This invention has a more specific object of circumferentially removing a section of bark that is uniform width from a branch or branches of plants, with the objective of more efficiently, as well as safely, air layering the plants, not causing the death of plants which most tree banding devices or tools have as their object. The term "air layering" just used means: a method of propagation by the rooting of branches of woody plants, characterized by making an incision in the stem of the plant to be rooted, then wrapping sphaghum moss around the wounded stem; then this said area is moistened, covered tightly with oil paper, cheese cloth, wire screen or plastic film, then the treated branch left for a period of time until roots have established themselves in the sphagham moss; then the branch is cut away from the main stem of the plant and transplanted into soil.

A more specific object is to provide a tool or device for circumferentially removing a band of bark from plants without unduly damaging the growing plant, analogous to a surgeon removing tissue from a patient with a minimum of damage to the patient resulting from the cutting involved. Such a hand device must therefore efficiently remove the bark from the underlying woody portion of the plant, yet not gouge or otherwise damage the woody part of the growing plant that is to achieve the propagation.

There have been previously invented forestry tools for girding trees, which have parallel cutting surfaces. One such is to be found in U.S. Pat. No. 2,552,652 to Henry E. Stasiek. This device has two curved cutting members joined for relative movement by a hinge. Its cutting members each have angle members having a blade portion and back portion curved slightly, the blade portion being provided on the inside of the curve with saw teeth; there are chisel teeth fastened between the handle of the device and the hinge at spaced intervals, and the saw teeth are triangular. It is quite obvious that this forestry tool would seriously wound growing plants, rendering them unfit for air layering using the wound produced. Said U.S. Pat. No. 2,552,652 states: "A tree receives its life through the bark, and the removal of bark around the tree at any one point will kill the tree. This is a process used by foresters and is called "girdling". Mostly in the removal of bark from plant limbs sharp knives have been employed by nurserymen, which entails some danger to the individual but with care as to the plant life." U.S. Pat. No. 1,261,689 to Geo. M. Bristle is a bark remover, a "lumberman's tool". This peeling instrument has a handle to which a metal part is attached, formed from a single piece having two arms which have flattened portions separated by a section leaving space between the arms for the bark to pass through as it is being removed. These flattened portions and the intermediate portion have "a cutting edge"; the arms are curved downwardly from the handle. This device, "lumberman's tool", would not lend itself very well to the rather delicate operation on living plants for the removal of a section of bark circumferentially as a step in air layering of plants.

Having stated some objects of the present invention and also stated wherein two inventions for foresters or lumbermen, which have a small similarity to the present invention, are deficient for sectional circumferentially removing bark from a plant for air layering, the features of the present invention will be now set forth.

2. THE DESCRIPTION OF THE INVENTION VIA AN EMBODIMENT

The features of our invention are pointed out below in detail, reference being had to the accompanying drawing, in which several views are offered; similar reference characters indicate corresponding parts throughout the several views.

FIG. 1 is a perspective view of the invention in operating position.

FIG. 2 is a side elevation thereof.

FIG. 3 is an enlarged sectional view, taken along line 3—3 of FIG. 1.

FIG. 4A is a sectional view taken along line 4—4 of FIG. 3, likewise 4-B.

FIG. 5 is a view showing bark stripping subsequent to scoring of the plant.

Upper jaw 1 of the hands-operable tool or device, to which device the numeral 2 has been assigned, has two parallel, downwardly projecting blades 3 intergral with the roof of the device bearing the numeral 4; each blade has a sharp cutting edge, numbered 5. At the front of the upper jaw 1 is a downwardly projecting, slightly inwardly tool, blade 6, which likewise has a sharp cutting edge 7.

The lower jaw, numbered 8, likewise has two parallel, but upwardly projecting blades, identified by the numeral 9, each having a sharp cutting edge 10. At the front part of the lower jaw is an upwardly, slightly inwardly projecting blade 11, which also, like its cooperating upper blade, numbered 6, has a sharp cutting edge 12. Jaws 1 and 8 are firmly attached to handle, numbered 13, as shown in FIG. 3, by means of screws 14 extending through the end of handle 13 and the base end of the roof of jaw 1, and screw 15 extending through the end (bottom) of the handle and the base end of the floor of jaw numbered 8.

As seen from FIG. 3, jaws 1 and 8 are formed from one piece of metal. Viewing FIGS. 2 and 3 of the drawing, it will be observed that the parallel blades 3 of the upper jaw 1 at its base or lower end overlap the corresponding parallel blades of the lower jaw 8. To achieve this and for smoother handling, the terminal end of upper jaw 1 is trimmed, so that it does not extend below lower jaw 8, and a hole numbered 16 is made in both members; see FIG. 2 for this. To make more secure upper jaw 1 to lower jaw 8, screws 17 are inserted through each of the jaws 1 and 8 from opposite sides, anchoring in the handle 13. Both from FIGS. 2 and 3 it can be seen that handle 13 at its terminal end has a hole or recess, into which the jaws 1 and 8 extend. The handle is formed from a metal pipe which provides this, the pipe being cut away, as shown in FIG. 1 to make the accomodation for the jaws 1 and 8.

In the drawing figures, the jaws have an angle of about 40°. The angle formed by the upper and the lower jaws of this device, for circumferentially removing a strip of bark, must be sufficiently large to accomodate the circumference of the branches or limbs of the plant, whereby the limb can be pressed against the parallel blades of the jaws to make two parallel, circular cuts in the bark of the limb and through the bark, in fact, so that the upper jaw's downwardly projecting front blade with sharp cutting edge can upon pressure detach the strip of bark from the plant's limb being treated. The angle between the jaws is, as to be seen, not critical, but should not exceed 90°. The distance apart of the parallel blades that have the cutting edges is not critical but has practical limits, such as 1 inch to one and a third inches. The parts of this device for circumferentially removing a band or strip of bark from limbs of plants will be assumed to be made from suitable materials, and not limited to a particular metal, however the metal of the blades, which have the cutting edges, should be of a kind that can retain a keen cutting edge preferably, of course. Steel 0.030 is suitable. The blades are bent suitably on 1/32¾radius. The handle can be of 3/4th inch diameter tubing.

Having described the structure of this device, its operation will now be set forth, making reference for a clearer understanding to the several views in the drawing when expedient. While holding the device or cutting tool, numbered 2, in one hand, by its handle 13, put the branch of the plant using the other, now the free hand, between the fork made by the jaws 1 and 8. Then while applying some forcing pressure, rotate the tool, itself, 180° around the plant. This step, if properly done, produce two parallel cuts, encircling the branch and cutting through the first layer of bark. The next step will remove the bark, itself. Now place the front, upper blade with its cutting edge perpendicular substantially and between the parallel cuts on the plant. Apply pressure while peeling the bark off in a circular motion. This branch of the plant is now ready for air layering, using damp sphaghum moss. Air-layering is the ultimate objective of this device. Whereas the last step is the one to which the utility of the present invention is related, it is not a structural part of the device of this present invention. Nor is this invention limited in its utility to that use, obviously.

In the description above of this invention, referring to the drawing figures, each jaw with a protruding end blade with sharp edge has been mentioned. In the operation of the device, the step of removal of the bark, per se, between the two parallel cuts, the reference has been to the downwardly projecting end blade as the functioning part thereof. The use of the two outer or end blades simultaneously is not brought into play. Therefore it is contemplated that structurally this device may be constructed with only one front or outer cutting blade with sharp cutting edge. Practically it is better to have two end blades because when one is dull or damaged the tool or device will still function. Therefore the device with but one end or front cutting blade is not the preferred embodiment, but is an embodiment nevertheless.

While we have shown and described a preferred embodiment of this invention, we are aware that structural changes may be made without departing from the spirit of the invention. And we therefore claim as our own all such modifications as fairly within the scope of the appended claims.

We claim as our invention:

1. A hand operable device for circumferentially removing a secion of bark from plants, characterized by an upper and a lower jaw, said jaws being jointed at one end forming an angle at its base therebetween sufficiently large to permit the introduction of the plant with bark thereon between the jaws, the upper and lower jaws respectfully having a substantially flat roof portion and flat floor portion, the said jaws each having parallel blades extending approximately vertical toward one another from the roof and the floor of the respective jaws, said blades each having a cutting edge, the outer extremity of the upper jaws having a blade with a cutting edge extending the width between its said parallel blades and downwardly at a slight inward angle to a distance beyond the width of the parallel blades of that jaw being, the joined end of the jaws attached to a handle and affixed firmly thereto, the device being rotatable around the circumference of the plant being treated.

2. A device as set forth in claim 1, wherein the outer edge of the lower jaw has a blade with a cutting edge extending the width between its parallel blades and upwardly at a slight inward angle to a distance beyond the width of the parallel blades of that jaw.

3. A device as set forth in claim 1, wherein the upper and the lower jaws are formed from one piece of metal.

4. A device as set forth in claim 1, wherein said handle is a pipe.

* * * * *